US007636971B2

(12) United States Patent
DeMoss

(10) Patent No.: US 7,636,971 B2
(45) Date of Patent: Dec. 29, 2009

(54) INNERSPRING DAMPENING INSERTS

(75) Inventor: Larry K. DeMoss, Greensboro, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 12/016,374

(22) Filed: Jan. 18, 2008

(65) Prior Publication Data

US 2009/0183315 A1 Jul. 23, 2009

(51) Int. Cl.
*A47C 23/04* (2006.01)
*A47C 27/05* (2006.01)

(52) U.S. Cl. ..... 5/716; 5/717; 5/718

(58) Field of Classification Search ..... 5/716–718, 5/655.7, 739

See application file for complete search history.

(56) References Cited

U.S. PATENT DOCUMENTS

| | | | | | |
|---|---|---|---|---|---|
| 2,446,775 | A * | 8/1948 | Marsack | 5/720 |
| 2,585,415 | A * | 2/1952 | Toms | 5/721 |
| 2,826,769 | A * | 3/1958 | Drews | 5/717 |
| 2,940,089 | A * | 6/1960 | Koenigsberg | 5/717 |
| 3,010,122 | A * | 11/1961 | Koenigsberg | 5/721 |
| 3,099,021 | A * | 7/1963 | Wetzler | 5/718 |
| 3,618,146 | A * | 11/1971 | Ferdinand | 5/717 |
| 3,822,426 | A * | 7/1974 | Mistarz | 5/717 |
| 3,981,033 | A * | 9/1976 | Toda | 5/717 |
| 5,210,890 | A * | 5/1993 | Hagglund | 5/239 |
| 5,239,715 | A * | 8/1993 | Wagner | 5/717 |
| 5,452,488 | A * | 9/1995 | Reinhardt | 5/729 |
| 5,467,488 | A * | 11/1995 | Wagner | 5/716 |
| 5,469,590 | A * | 11/1995 | Simon | 5/721 |
| 5,687,439 | A * | 11/1997 | Wagner | 5/717 |
| 5,724,686 | A * | 3/1998 | Neal | 5/717 |
| 5,787,532 | A * | 8/1998 | Langer et al. | 5/717 |
| 5,832,551 | A | 11/1998 | Wagner | |
| 6,023,803 | A * | 2/2000 | Barman | 5/716 |
| 6,128,798 | A * | 10/2000 | Barman et al. | 5/716 |
| 7,082,635 | B2 * | 8/2006 | Barman et al. | 5/717 |
| 2006/0260062 | A1 * | 11/2006 | Barman et al. | 5/717 |
| 2009/0013476 | A1 * | 1/2009 | Rinchetti | 5/717 |
| 2009/0183314 | A1 * | 7/2009 | Demoss | 5/716 |
| 2009/0183315 | A1 * | 7/2009 | DeMoss | 5/718 |

* cited by examiner

*Primary Examiner*—Robert G Santos
(74) *Attorney, Agent, or Firm*—Roetzel & Andress

(57) ABSTRACT

Dampened and zoned innersprings for use in support systems such as mattresses and furniture have dampening inserts in the form of foam pieces which fit integrally with the springs or coils of an innerspring. Dampened innersprings with one or more foam dampeners inserted between springs or coils of an innerspring, and more particularly foam dampener inserts which are configured to extend between multiple adjacent or aligned springs or coils, and which also have segments which fit between individual turns or convolutions of each spring or coil with which the insert is engaged. Mechanical engagement of the innerspring by the foam dampening inserts insures alignment and registration of the innerspring and foam components, and compression and recoil of the individual coils of the innerspring occurs in conjunction with compression and decompression of the foam dampening inserts.

36 Claims, 8 Drawing Sheets

INNERSPRING DAMPENING INSERTS

FIELD OF THE INVENTION

The invention is in the general field of reflexive support systems, springs and spring systems, including support systems for humans such as seating and bedding.

BACKGROUND OF THE INVENTION

Different types of springs and spring systems are commonly used as the reflexive core of seating and support products such as chairs and mattresses. A common spring system which is used in mattresses and some upholstered furniture is the so-called "innerspring" which can be in one form a plurality of similarly or identically formed springs which are interconnected in an array or matrix. An innerspring provides a distributed generally homogeneous reflexive support system to give underlying support to an expanse such as the sleep surface of a mattress. The uniform spring rate across the expanse results from the common configuration of each of the interconnected springs. Attempts to alter the spring rate and feel of an entire innerspring or support areas of an innerspring involve the use of different types and amounts of materials such as foam, textiles and natural fibers as overlays on the innerspring. While the use of such materials does alter the feel and performance of the support system, it does not of course alter the spring rate of the underlying or internal innerspring.

Innersprings which are made of formed steel wire are manufactured by wire forming machinery which forms the individual springs or coils, and then connects them together by smaller lacing wires or other fasteners. Once the machines are set up to make a particular spring or coil design and interconnection, large runs are made and it is difficult to change the form of the springs and innerspring. Therefore, with current innerspring production technology, it is not practical to produce a single innerspring which has variable or non-homogeneous spring rates and support characteristics in different areas of the innerspring.

SUMMARY OF THE INVENTION

The invention provides dampened innersprings for use in support systems such as mattresses and furniture, by the provision of dampening inserts in the form of foam pieces which fit integrally with the springs or coils of an innerspring. In accordance with one principal aspect of the disclosure, a dampened innerspring is provided in which a foam dampener is inserted between springs or coils of an innerspring, and more particularly foam dampener inserts which are configured to extend across multiple adjacent or aligned springs or coils, and which also have parts which fit between individual turns or convolutions of each spring or coil with which the insert is engaged. Mechanical engagement of the innerspring by the foam dampening inserts insures alignment and registration of the cooperative components, with or without interposed fasteners.

In accordance with one aspect of the disclosure and invention, there is provided a foam dampened innerspring which includes an innerspring formed by a plurality of springs connected together in an array wherein the springs are arranged in rows and columns, each spring having a body with a first end and a second end, the body of each spring being generally cylindrical and having a longitudinal axis and an outer diameter, the springs being spaced apart in the rows and columns and connected together in a spaced apart arrangement with each spring being spaced from each adjacent spring in the array; at least one foam dampening insert located in the innerspring in spaces between springs of the innerspring, the foam dampening insert having a central core which fits between the bodies of adjacent springs, and a first segment which extends from the central core and into an opening region of a first spring to at least partially intersect a longitudinal axis of the first spring, and a second segment which extends from the central core and into an opening region of a second spring which is adjacent to the first spring and to at least partially intersect a longitudinal axis of the second spring.

These and other aspects of the disclosure and invention are described in further detail herein with reference to the accompanying drawing Figures.

DESCRIPTION OF THE DRAWINGS

In the Drawings which constitute a part of the disclosure.

DETAILED DESCRIPTION OF PREFERRED AND ALTERNATE EMBODIMENTS

Figure 1:
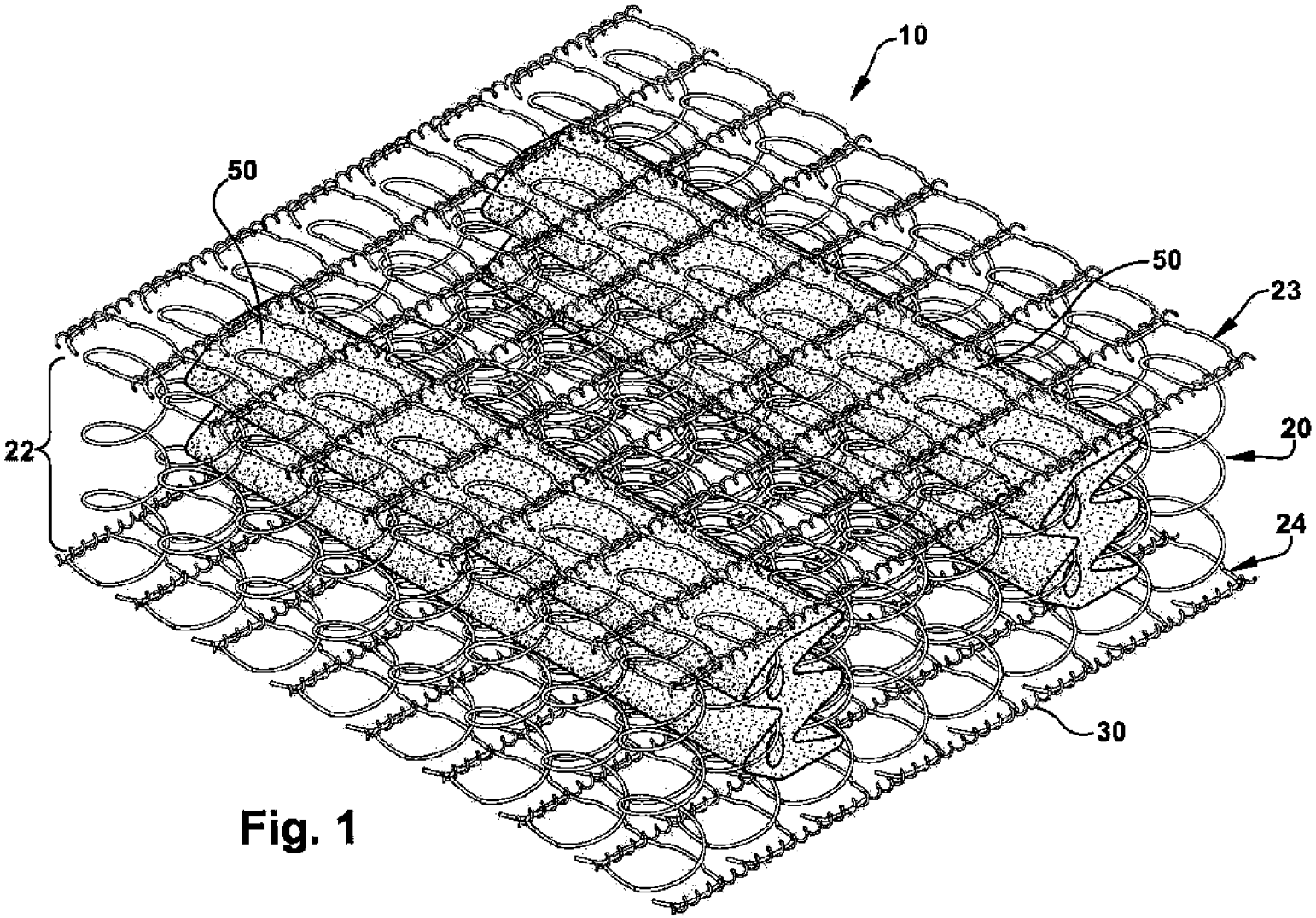
FIG. 1 is a perspective view of an innerspring of the disclosure with dampening inserts of the disclosure.

As shown in the drawings Figures, an innerspring, generally referenced at 10, has a plurality of springs or coils 20 (herein referred to alternatively as "coils" or "springs", although the disclosure and invention is not limited to any one particular type or form of spring or coil or other spring or reflexive device). The coils 20 are arranged in an array, such as an orthogonal array of columns and rows, and interconnected by lacing wires 30 which in one form or helical wires which are laced about turns of adjacent coils and typically run transverse across a width of the innerspring, but which can be run in other directions. The lacing wires can be located at either or both ends of the coils 20, as shown for example in FIG. 3. Coil ends 23 and 24 are formed at opposite axial ends of the coil body 22 and aligned in the opposing (upper and lower) planes of the innerspring as described. The coil ends 23 and 24 are aligned in planes which define support surfaces of the innerspring 10. In many innersprings of this type, there is open space between the adjacent coil bodies 22, necessary to allow flexure, compression and deflection of the coils and relative movement without inter-coil contact.

Figure 3:
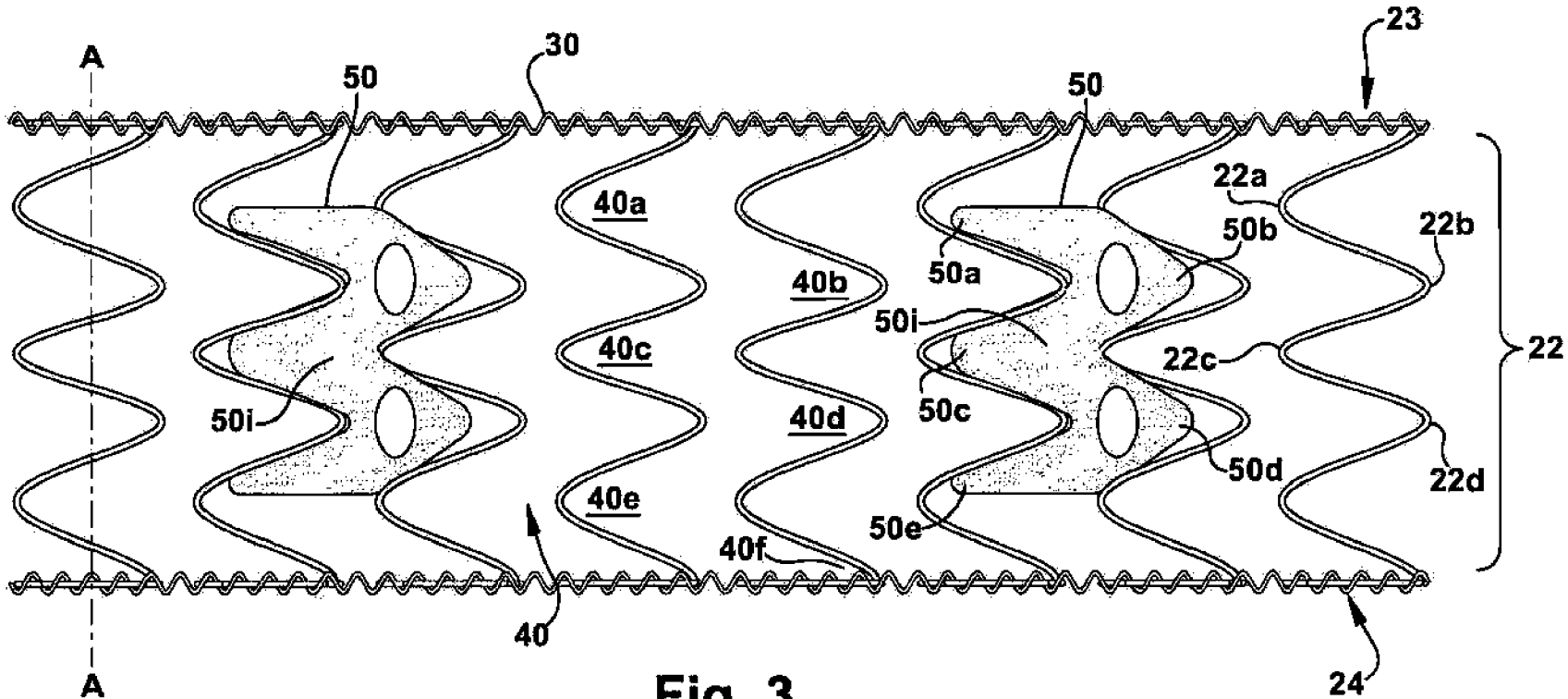
FIG. 3 is a partial side elevation of the innerspring of FIG. 1.
Figure 4:
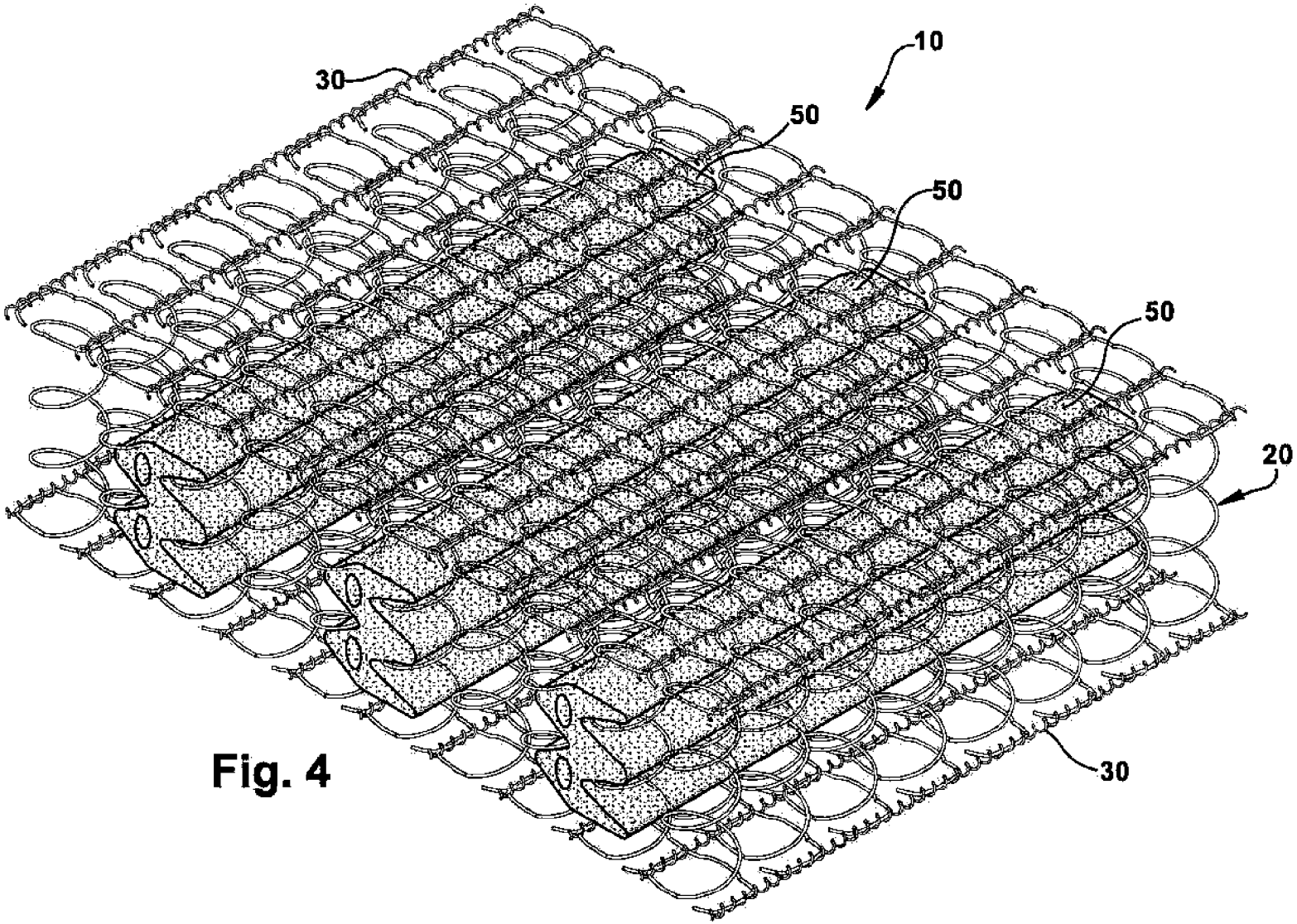
FIG. 4 is a perspective view of an alternate embodiment of an innerspring of the disclosure and dampening inserts of the disclosure.
Figure 5:
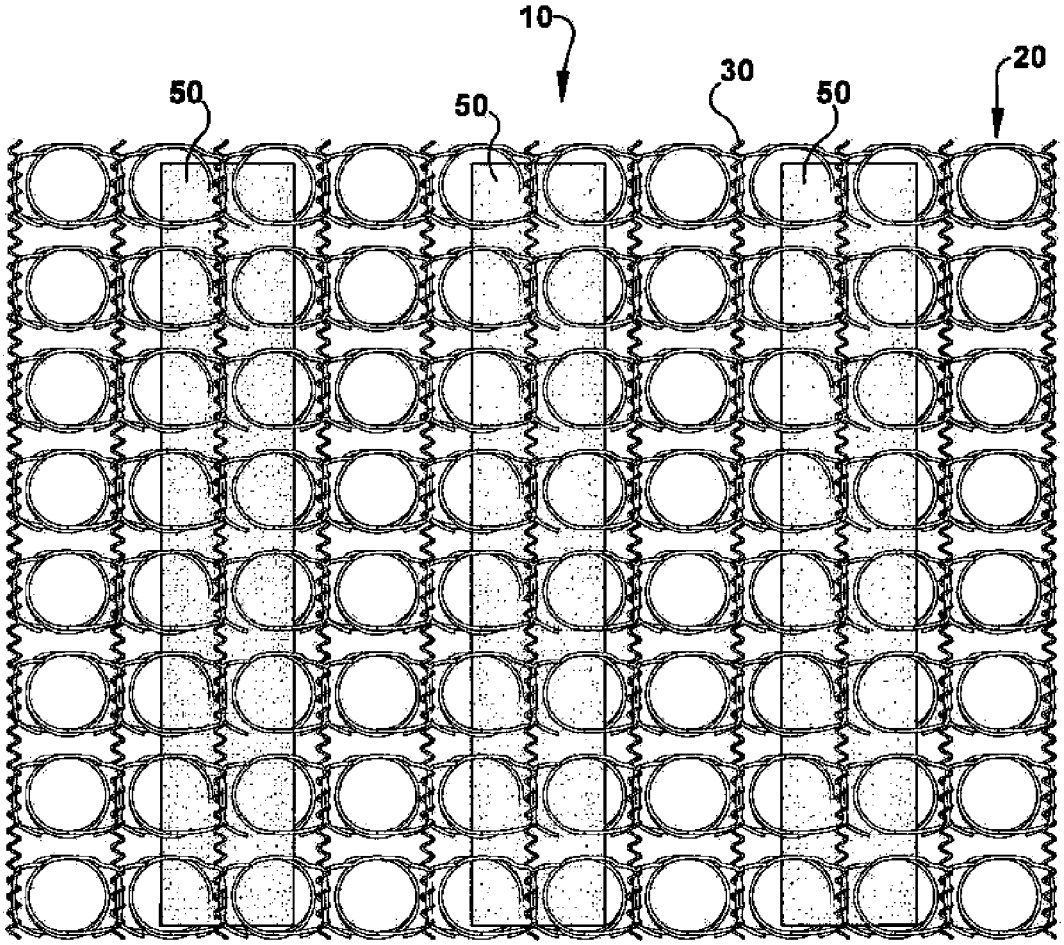
FIG. 5 is a plan view of the innerspring of FIG. 4.
Figure 6:
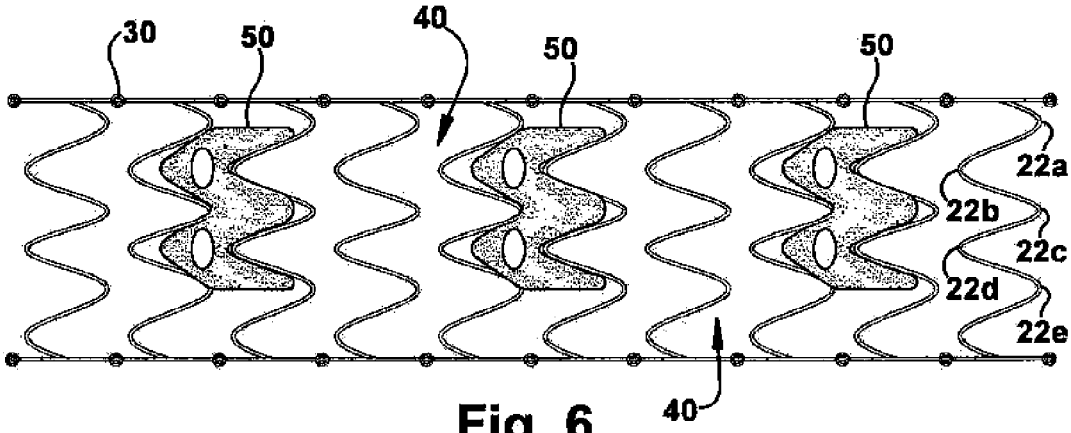
FIG. 6 is a partial side elevation of the innerspring of FIG. 4.

The coils 20 are shown as helical type coils, wherein each coil has a helical and cylindrical form coil body formed by multiple helical turns of wire about a generally linear coil axis A. The generally cylindrical coil body is defined by the outer radial extent of each of the turns of the wire helix. For each coil, the areas which are within the turns of the wire helix which form the coil body are within the coil body. As illustrated in FIGS. 3 and 6, the coil bodies 22 may include for example five turns 22*a*, 22*b*, 22*c*, 22*d* and 22*e*, each of which has an outermost point from the coil axis A. Each of the five turns is generally laterally aligned with the corresponding turns of adjacent coils as shown. The repeating helical pattern of the rows of coils thus forms a repeating pattern of waveform gaps or openings between the coils, generally indicated at 40. As further described, foam dampening inserts 50 are located to varying degrees within the gaps or openings 40.

Figure 2:
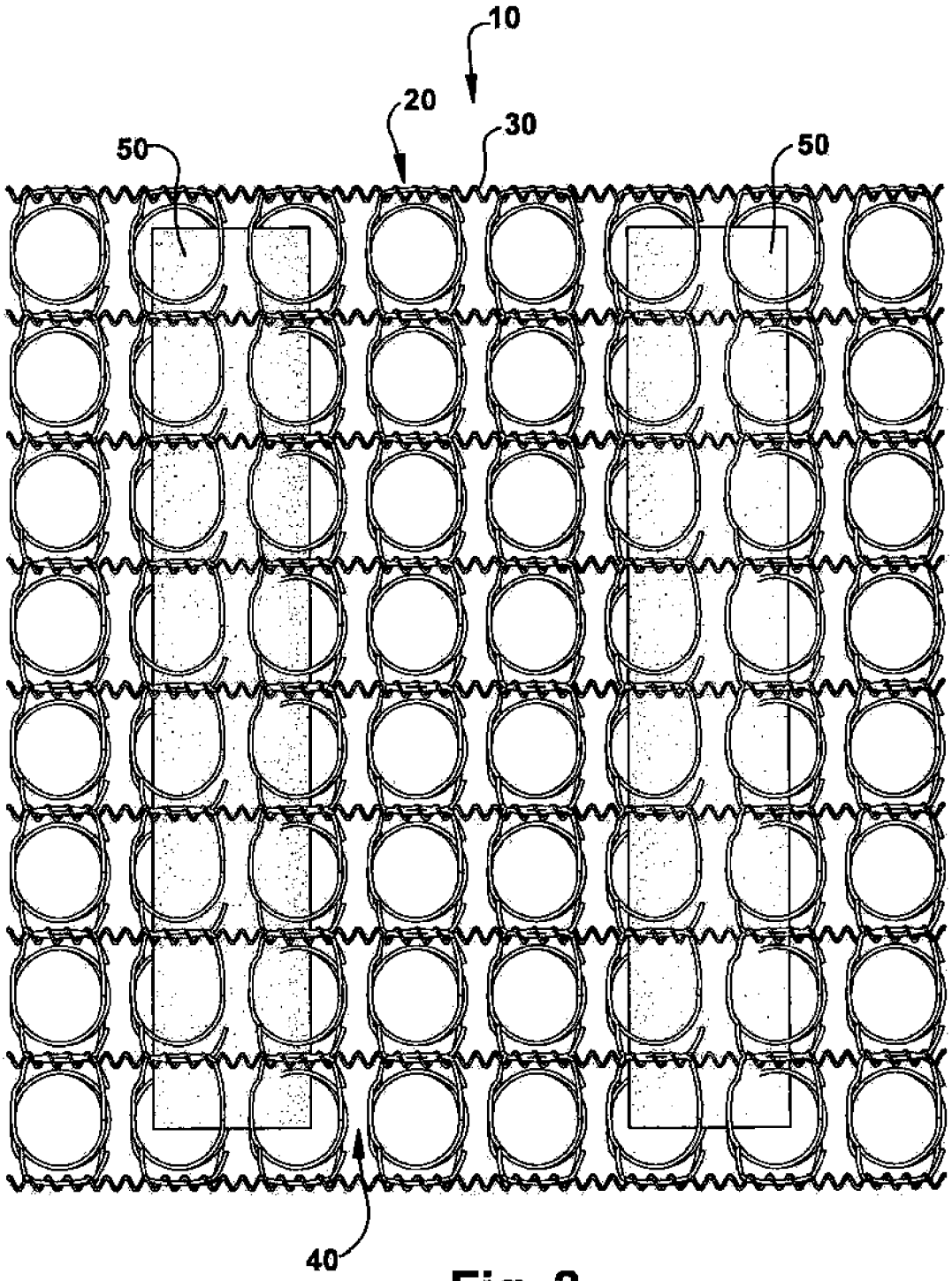
FIG. 2 is a plan view of the innerspring of FIG. 1.

In a conventional innerspring the openings between the coils are generally uniform in each lateral direction, i.e., the longitudinal and transverse directions of the innerspring. Therefore, the foam dampening inserts 50 can be installed in the innerspring in transverse or longitudinal directions, or both, as illustrated by the Figures. In the Figures, the lacing wires 30 are shown oriented in a transverse direction in the innerspring 10 as the conventional arrangement, although longitudinal orientation of the lacing wires 30 is also possible. Accordingly, the foam dampening inserts 50 may be oriented traverse (perpendicular) to or parallel with the lacing wires 30. For example, FIGS. 1-3 illustrate foam dampening inserts 50 installed in an innerspring 10 in an orientation transverse to the lacing wires 30, or in other words in a longitudinal direction of the innerspring 10. FIGS. 4-8 illustrate foam dampening inserts 50 installed in an innerspring 10 in an orientation parallel to the lacing wires 30, in a transverse width-wise direction of the innerspring 10. And FIGS. 9-12 illustrate foam dampening inserts 50 installed in innersprings 10 in both longitudinal and transverse directions with respect to the longitudinal and transverse directions of the innersprings.

The foam dampening inserts 50 have a cross-sectional configuration which includes segments which fit between the coils, in the gaps or openings 40 formed between the spaced-apart coils, and segments or parts which fit within the coil bodies of adjacent coils. As shown for example in FIGS. 3, 6 and 7, with the coils 20 in generally helical form, the turns 22 of the coil are generally laterally aligned and together form a wave-form or serpentine spaces or openings 40 between each coil and between the rows and columns of coils. In other words, the boundaries of the spaces or openings 40 are defined by the outer diameter form of the adjacent coils 20. The openings 40 have different zones or areas or regions as indicated, 40*a*, 40*b*, 40*c*, 40*d*, 40*e* and 40*f*, (also referred to herein in the alternative as "opening regions" or "spaces") defined by the helical turns of the opposing coils 20. The opening regions 40*a*-40*f* extend into the respective coil bodies. The foam dampening inserts 50 are configured to fit within the openings 40 and within at least two or more of the opening regions 40*a*-40*f* in order to engage with and maintain alignment and registration with the coils of the innerspring. The number of openings 40 will vary according to the number of helical turns in the coil body.

One representative cross-sectional form of a foam dampening insert 50 of the disclosure includes a central core 50*i* and segments 50*a*, 50*b*, 50*c*, 50*d* and 50*e* as labeled, which extend from the central core 50*i* in generally opposing and first and second directions, and fit respectively within opening regions 40*a*, 40*b*, 40*c*, 40*d* and 40*e* of an opening 40 between two adjacent coils or rows of adjacent coils. Because the different segments 50*a*-50*e* of the foam dampening insert 50 are preferably located at different or unique elevations relative to the central core 50*i* and respective the coil axis A, and because they project laterally from central core 50*i* of the insert into the adjacent coil bodies and intersect the coil axes A, the foam dampening insert 50 is thereby held securely in place by engagement with the coils for permanent installation and spring dampening performance. As further shown in FIG. 3, the exact form of the segments 50*a*-50*e* of the foam dampening insert 50 may vary, so long as they effectively extend into the coil bodies, i.e., into the respective opening regions 40*a*-40*e*. As noted, because the openings 40 exist between the coils in both the transverse and longitudinal directions of the innerspring, the described engagement of the foam dampening inserts 50 with the openings 40 is essentially the same in both orientations in a conventional innerspring wherein the coils equally spaced omni-directionally. The invention however is also applicable to innersprings wherein the coils may be differently spaced, for example in the transverse direction, than in the longitudinal direction, in which case accordingly sized foam dampening inserts could be made per the different required dimensions.

Also, because the number of openings 40 may be greater than the number of segments 50*a*-*n* of the foam dampening insert 50, the foam dampening insert 50 may be configured with any number of segments, including fewer than or greater than five, as shown. In the case where there are a greater number of openings 40 than segments 50*a*-*n* of the foam dampening insert 50, the foam dampening insert 50 can be located equidistant, or closer to one or the other side of the innerspring, as defined by the planes in which the coil ends 23, 24 are located.

A further design aspect and feature of the foam dampening inserts 50 of the disclosure is the lateral extension of the segments 50*a*-50*e* from the central core 50*i* which resides principally between the adjacent coils. This lateral extension allows the segments 50*a*-50*e* to act as leaf spring members in concert with the compression and recoil of the helical turns of the coil bodies. As the coils are compressed under a normal load, the foam dampening insert 50 is correspondingly compressed in at least two principle modes, one by compression of the insert 50 in its substantial entirety, i.e., along an axis generally parallel to the coils axes A and compression of the central core 50*i*, and by vertical deflection of the laterally extending segments 50*a*-50*e* induced by contact with a corresponding turn or segment of the engaged coil. Because the foam dampening insert has a spring rate which may be different than that of the coils, such as a spring rate which is less than that of the coils or less than an aggregate spring rate of the innerspring 10, the foam dampening insert 50 thus acts as a dampener to reduce the overall spring rate of the innerspring and mattress, in the region or zone where the insert 50 is installed in the innerspring 10. In this regard the zone or overall or average spring rate of the innerspring or mattress can be designed or tuned by combinations of the known spring rates of the coils and of the inserts 50. As known in the wire-forming arts, the spring rate of the wire form helical coils is determined by the coil design, including such design factors as height, diameter, number of turns in the helix and angles or pitch between the turns. The spring rate of the innerspring is also affected by the number or density of coils, their relative arrangement and manner of interconnection, such as lacing wires.

The spring rate and/or dampening effect of the foam dampening inserts 50 is determined and can be adjusted by such factors as the type of foam material and additives used, density, method of formation (e.g., injection molded or extruded), and design configuration such as the cross-section including size and shape of the central core 50*i* and the number, size and shape and orientation of the segments 50*a*-50*e*. For example, openings or voids may be formed in the central core 50*i* in order to reduce material and accordingly alter the spring rate and dampening effect. The shape or shapes of the segments 50*a*-50*e* may be made to fit tightly or loosely with the corresponding regions 40*a*-40*e*, and may be tapered or contoured in accordance with the coil helix. In one design aspect, the cross-sectional thickness of one or more of the segments 50*a*-50*e* is less tan or substantially less than a cross-sectional thickness of the central core 50*i*. Also, the cross-sectional configurations may differ among the various segments 50*a*-50*e*, such as for example some being thicker than others, some having a different shape or profile, and some being tapered to a lesser or greater extent than others at points distant from the central core 50*i*. One or more openings or voids 50*o* may be formed in the foam dampening inserts 50, such as for example in the central core 50*i* or in any of the segments or regions. The size, shape and location of openings or voids 50*o* are further design parameters which can be set to establish the spring rate or dampening effect of the insert 50 in combination with an innerspring. These and other shapes, configurations and structures can be made as foam structures which are molded or extruded of suitable types of polyurethane foams and alloys thereof. A preferred method of manufacture is by extrusion through a die which defines the described cross-sectional configuration, in any lengths for widthwise or lengthwise installation dimensioned with innersprings. When made as extrusions, the foam dampening inserts 50 are formed with an exterior skin.

As shown in the Figures and mentioned, the foam dampening inserts 50 may be arranged in any number, any length and any orientation, or combinations thereof, with an innerspring 10. In a longitudinal orientation shown in FIGS. 1 and 2, the foam dampening inserts 50 run perpendicular to the transversely extending lacing wires 30. In the width-wise transverse orientation shown in FIGS. 4-8, the form dampening inserts are parallel with the transverse lacing wires 30. FIGS. 9-12 illustrate various combinations of longitudinal and transverse arrangements of different lengths of foam dampening inserts 50 within innersprings 10. Each section or piece of the inserts 50 can be closely abutted with an intersecting section or piece, or a space left therebetween. The number, size and location of the foam dampening inserts 50 can also create or define zones or regions of the innerspring which have different support characteristics from other zones or regions. These can accordingly be placed or designed for particular mattress application, such as creating increased support and/or pressure-reducing areas or zones in cooperation with overlying layers of material such as foam padding layers, woven and non-woven material layers and upholstery including padded upholstery.

Figure 7:
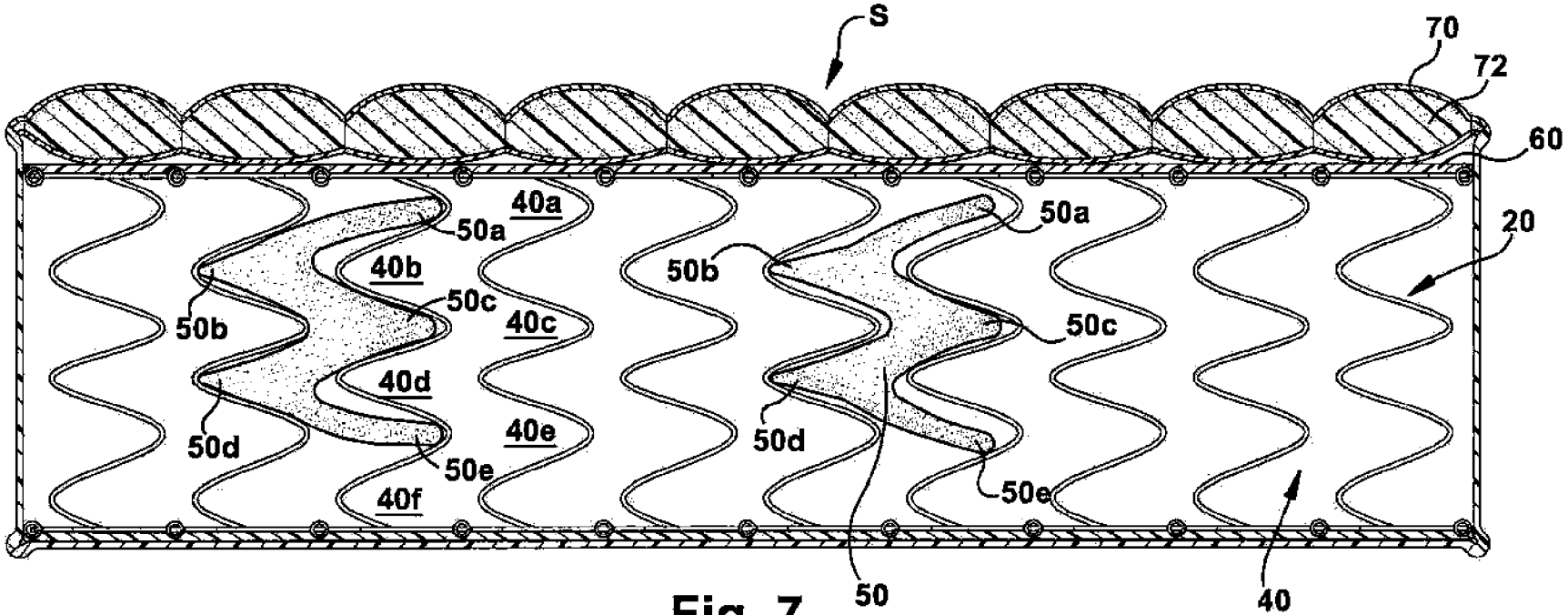
FIG. 7 is a partial side elevation of a foam dampened innerspring of the disclosure.
Figure 8:
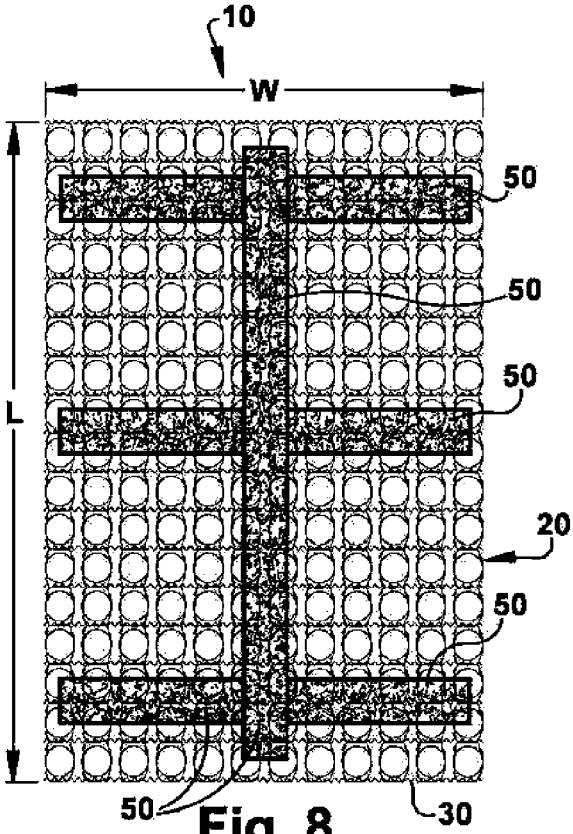
FIGS. 8-12 are plan views of various alternate and representative embodiments of foam dampened innersprings of the disclosure.
Figure 9:
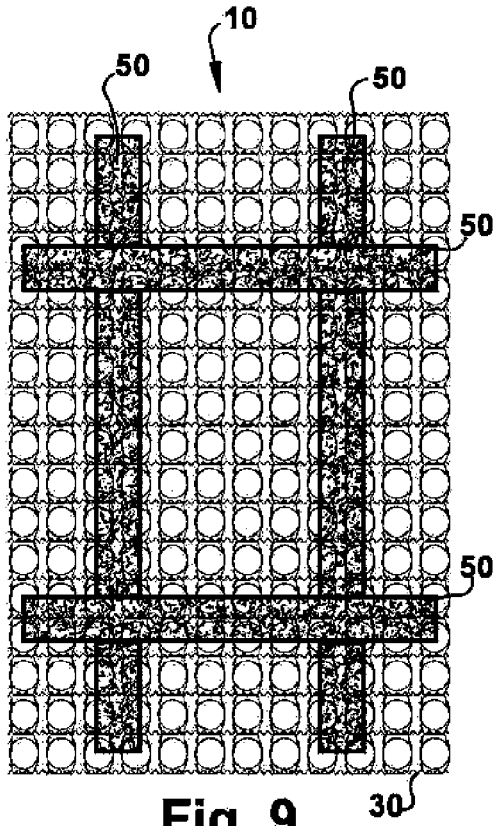
Figure 10:
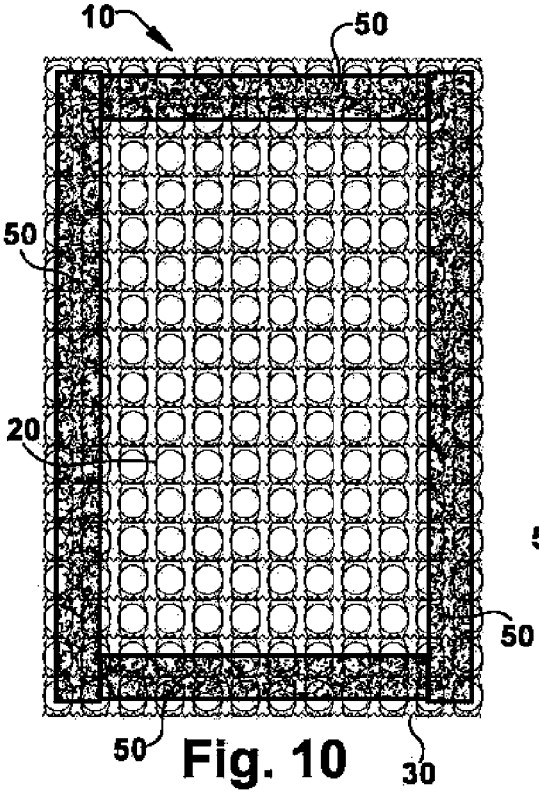
Figure 11:
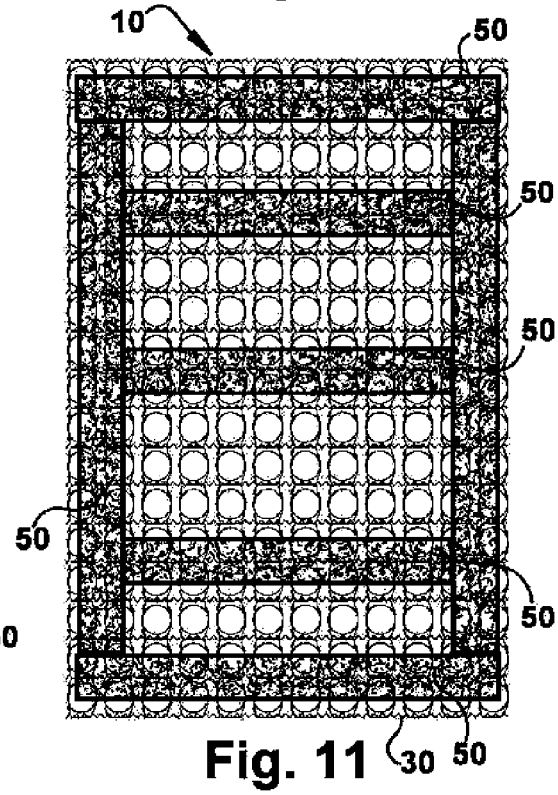
Figure 12:
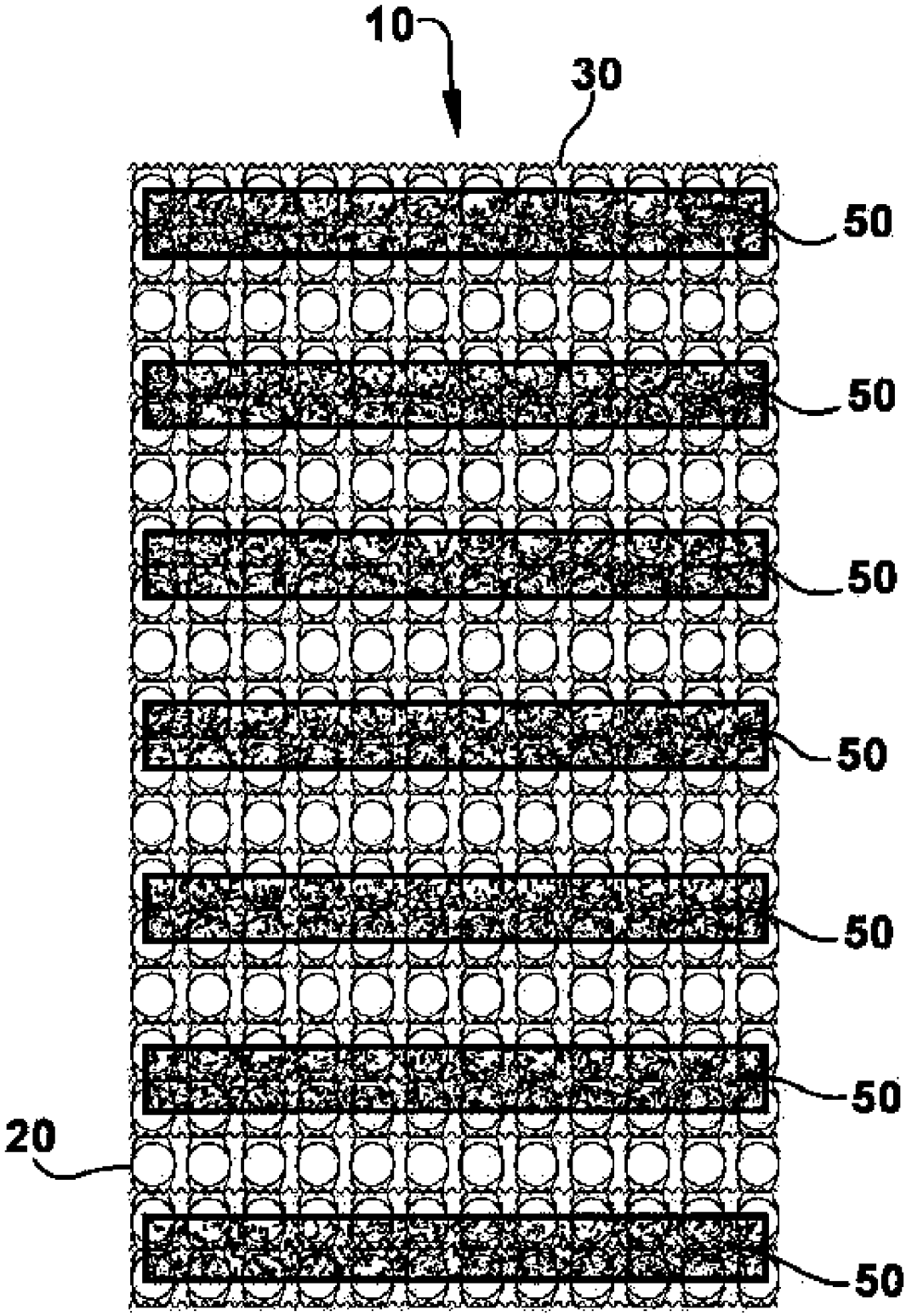

FIG. 7 illustrates a foam dampened innerspring of the disclosure in combination with one or more internal layers of material or materials 60 which constitute padding or compressible support layers, and an exterior upholstery layer 70 which may further include additional or integral material 72 as additional padding material for a sleep or support surface S. In this manner a mattress may be configured with one or two support or sleep surfaces S. Internal material layers 60 may include foam, natural and/or synthetic materials such as cotton, wool, feathers, and/or woven or non-woven fibers.

What is claimed as the invention is:

1. A foam dampening innerspring comprising:

an innerspring formed by a plurality of springs connected together in an array wherein the springs are arranged in rows and columns, each spring having a body with a first end and a second end, the body of each spring being generally cylindrical and having a longitudinal axis and an outer diameter, the springs being spaced apart in the rows and columns and connected together in a spaced apart arrangement with each spring being spaced from each adjacent spring in the array;

at least one foam dampening insert located in the innerspring in spaces between springs of the innerspring, the foam dampening insert having a central core which fits between the bodies of adjacent springs;

a first segment which extends in a first direction from the central core and into an opening region of a first spring to at least partially intersect a longitudinal axis of the first spring;

a second segment which extends in a second direction from the central core and into an opening region of a second spring which is adjacent to the first spring and to at least partially intersect a longitudinal axis of the second spring;

a third segment which extends in the first direction from the central core and into an opening region of the first spring to at least partially intersect a longitudinal axis of the first spring;

a fourth segment which extends in the second direction from the central core and into an opening region of the second spring to at least partially intersect a longitudinal axis of the second spring; and a fifth segment which extends in the first direction from the central core and into an opening region of the first spring to at least partially intersect a longitudinal axis of the first spring, wherein each segment of the at least one foam dampening insert is at a different elevation than every other segment of the at least one foam dampening insert.

2. The foam dampened innerspring of claim 1, wherein the at least one foam dampening insert is located between adjacent rows of springs in the innerspring.

3. The foam dampened innerspring of claim 1, wherein the at least one foam dampening insert is located between adjacent columns of springs in the innerspring.

4. The foam dampened innerspring of claim 1, wherein the at least one foam dampening insert has at least five segments which extend bi-laterally from the central core.

5. The foam dampening insert of claim 2, wherein the at least one foam dampening insert has a length which is approximately equal to a width of the innerspring.

6. The foam dampened innerspring of claim 3, wherein the at least one foam dampening insert has a length which is approximately equal to a length of the innerspring.

7. The foam dampened innerspring of claim 1, wherein the springs of the innersprings are wire form springs, and the segments of the at least one foam dampening insert fit between turns of wire in the first and second springs.

8. The foam dampened innerspring of claim 1, wherein the segments of the at least one foam dampening insert are tapered away from the central core of the at least one foam dampening insert.

9. The foam dampening innerspring of claim 1, wherein a first segment of the at least one foam dampening insert has a first cross-sectional configuration and a second segment of the at least one foam dampening insert has a second cross-sectional configuration.

10. The foam dampened innerspring of claim 1, wherein the at least one foam dampening insert is an extruded foam structure with an exterior skin layer and a foam cellular structure inside the skin layer.

11. The foam dampened innerspring of claim 1, wherein the at least one foam dampening insert has a cross-sectional configuration in the general shape of the letter W.

12. The foam dampened innerspring of claim 1 comprising at least two foam dampening inserts engaged with the innerspring and spaced apart by at least one row or column of springs.

13. The foam dampened innerspring of claim 1 comprising at least two foam dampening inserts which are engaged with the innerspring in a parallel orientation.

14. The foam dampened innerspring of claim 1 comprising at least two foam dampening inserts which are engaged with the innerspring in a widthwise and parallel orientation.

15. The foam dampened innerspring of claim 1 comprising at least two foam dampening inserts which are engaged with the innerspring in a lengthwise and parallel orientation.

16. The foam dampened innerspring of claim 1 comprising at least one foam dampening insert engaged with the innerspring in a widthwise direction, and at least one foam dampening insert engaged with the innerspring in a lengthwise direction.

17. The foam dampened innerspring of claim 1 comprising at least two foam dampening inserts engaged with the innerspring proximate to at least two edges of the innerspring.

18. The foam dampened innerspring of claim 1 in combination with padding and upholstery material which forms a mattress.

19. The foam dampened innerspring of claim 1 in combination with padding and upholstery in the form of a one-sided mattress.

20. A foam dampened innerspring comprising:

a plurality of helical form coils interconnected in an array in which the coils are general aligned in rows and columns, each of the coils having a generally cylindrical coil body formed by helical turns of wire with openings between each of the helical turns of wire, and first and second ends to the coil body also formed by the wire;

each of the coil bodies being spaced apart in the array;

at least one foam dampening insert located between and engaged with two or more of the coils of the innerspring, the at least one foam dampening insert having a central core which fits in the space between the coils, a first segment which extends in a first direction from the central core at a first elevation and into an opening between the helical turns of wire in a first coil, and a second segment which extends in a second direction from the central core at a second elevation and into an opening between the helical turns of wire in a second coil, a third segment which extends in the first direction from the central core at a third elevation and into an opening between the helical turns of wire in the first coil, a fourth segment which extends in the second direction from the central core at a fourth elevation and into an opening between the helical turns of wire in the second coil, and a fifth segment which extends in the first direction from the central core at a fifth elevation and into an opening between the helical turns of wire in the first coil, wherein each segment of the at least one foam dampening insert is at a different elevation than every other segment of the at least one foam dampening insert.

21. The foam dampened innerspring of claim 20, wherein the central core of the at least one foam dampening insert is located between longitudinal axes of adjacent coils, and the first segment is intersected by a longitudinal axis of the first coil, the second segment is intersected by a longitudinal axis of the second coil, the third segment is intersected by a longitudinal axis of the first coil, the fourth segment is intersected by a longitudinal axis of the second coil, and the fifth segment is intersected by a longitudinal axis of the first coil.

22. The foam dampened innerspring of claim 20, wherein the at least one foam dampening insert comprises at least three segments at unique elevations which extend in a common first direction from the central core, and at least two segments at unique elevations which extend in a second direction from the central core.

23. The foam dampened innerspring of claim 20, wherein one or more of the segments of the at least one foam dampening insert is displaced or compressed by compression of the first or second coil.

24. The foam dampened innerspring of claim 20, wherein a foam dampening insert extends substantially an entire row of coils in the array of coils in the innerspring.

25. The foam dampened innerspring of claim 20, wherein a foam dampening insert extends substantially an entire column of coils in the array of coils in the innerspring.

26. The foam dampened innerspring of claim 20 comprising foam dampening inserts located proximate to a periphery of the innerspring.

27. A mattress with a foam dampened innerspring, comprising:

an innerspring having a plurality of coils interconnected in an array of columns and rows, the columns of coils being generally equally spaced apart, and the rows of coils being generally equally spaced apart, each coil having a generally helical wire form body with openings between helical turns of wire of the helical wire form body;

at least one foam dampening insert located in the innerspring between coils of the array, the at least one foam dampening insert having a central core which fits in a space between a row or column of coils of the array, and at least five segments which extend laterally from the central core and into one or more openings between the helical turns of wire of the helical wire form bodies of at least two adjacent coils of the array; and padding and upholstery material positioned over a support surface of the innerspring to form a mattress, wherein the at least one foam dampening insert has at least five segments which extend laterally from the central core and which are configured to fit within openings in the helical turns of the helical wire form bodies of adjacent coils, three of the at least five segments extending from the central core in a first direction and at three different elevations, and two of the at least five segments extending form the central core in a second direction at different elevations which are unique from the three different elevations of the other three segments.

28. The mattress of claim 27, wherein each of the segments of the at least one foam dampening insert are configured to fit in an opening in the helical wire form body of a coil and extend through a substantial cross-section of the coil so that the segments are intersected by a longitudinal axis of the coil into which the segment extends.

29. The mattress of claim 27, wherein each of the segments of the at least one foam dampening insert have a cross-sectional thickness in an area proximal to the central core which is greater than a cross-sectional thickness in an area distal from the central core.

30. The mattress of claim 27, wherein the at least one foam dampening insert has a cross-sectional configuration in the general configuration of the letter W.

31. The mattress of claim 27, wherein the at least one foam dampening insert is positioned within the innerspring closer to a bottom of the mattress than to a support surface of the mattress.

32. The mattress of claim 27, wherein the at least one foam dampening insert is positioned within the innerspring closer to a support surface of the mattress than to a bottom of the mattress.

33. The mattress of claim 27 comprising a plurality of foam dampening inserts which at least partially define different zones of the mattress.

34. The mattress of claim 27 comprising a plurality of foam dampening inserts at least some of which are located proximate to a perimeter of the innerspring and mattress.

35. The mattress of claim 27 comprising a plurality of foam dampening inserts, at least two of which are perpendicularly oriented within the innerspring.

36. The mattress of claim 27 comprising at least two foam dampening inserts each having a unique cross-sectional configuration.

* * * * *